US007921540B2

(12) United States Patent
Jiles et al.

(10) Patent No.: US 7,921,540 B2
(45) Date of Patent: Apr. 12, 2011

(54) SYSTEM OF COMPONENT S USABLE IN THE MANUFACTURE OF AN ACOUSTIC TRANSDUCER

(75) Inventors: Mekell Jiles, South Holland, IL (US); David Earl Schafer, Glen Ellyn, IL (US)

(73) Assignee: Knowles Electronics, LLC, Itasca, IL (US)

( * ) Notice: Subject to any disclaimer, the term of this patent is extended or adjusted under 35 U.S.C. 154(b) by 935 days.

(21) Appl. No.: 11/552,216

(22) Filed: Oct. 24, 2006

(65) Prior Publication Data

US 2007/0047756 A1 Mar. 1, 2007

Related U.S. Application Data

(62) Division of application No. 10/719,765, filed on Nov. 21, 2003, now Pat. No. 7,302,748.

(60) Provisional application No. 60/428,604, filed on Nov. 22, 2002.

(51) Int. Cl.
*H04R 31/00* (2006.01)

(52) U.S. Cl. ..... 29/594; 29/827; 29/609.1; 29/592.1; 381/312; 381/417

(58) Field of Classification Search ..... 29/592.1, 29/594, 609.1, 729, 739, 832–834, 827; 381/418, 381/312
See application file for complete search history.

(56) References Cited

U.S. PATENT DOCUMENTS

| | | | | |
|---|---|---|---|---|
| 3,502,822 | A | | 3/1970 | Sternfeld et al. |
| 3,777,078 | A | | 12/1973 | Boutros-Attia et al. |
| 3,935,398 | A | | 1/1976 | Carlson et al. |
| 4,126,769 | A | | 11/1978 | Broersma |
| 4,656,454 | A | * | 4/1987 | Rosenberger ..... 338/2 |
| 4,764,244 | A | * | 8/1988 | Chitty et al. ..... 216/20 |
| 5,351,550 | A | * | 10/1994 | Maurer ..... 73/727 |
| 5,757,947 | A | | 5/1998 | Van Halteren et al. |
| RE36,512 | E | | 1/2000 | Sone |
| 6,078,677 | A | | 6/2000 | Dolleman et al. |

(Continued)

FOREIGN PATENT DOCUMENTS

EP 0 851 710 A1 7/1996

(Continued)

OTHER PUBLICATIONS

International Search Report for PCT/US2003/037268, dated Apr. 24, 2004.

(Continued)

*Primary Examiner* — Minh Trinh
(74) *Attorney, Agent, or Firm* — Fitch, Even, Tabin & Flannery

(57) ABSTRACT

A linkage assembly (140) is used for mechanically coupling an armature (124) and a diaphragm (118) of a balanced receiver (100), the linkage assembly (140) formed from a first linkage member (822) displaced from a strip of stock material (800) relative to the plane of the stock material (800) and a second linkage member (826) displaced from the strip (800) relative to the plane. The first and second linkage members (822, 826) are then joined while secured to the strip (800). At least one severable connecting member (870*a-c*) securing the linkage member to the strip (800) is severed to release the linkage member from the strip for assembly of the linkage member into the receiver. A method of forming a three-dimensional structure from flat stock is used to form the linkage assembly (140).

5 Claims, 13 Drawing Sheets

U.S. PATENT DOCUMENTS

| | | | | |
|---|---|---|---|---|
| 6,097,829 | A | 8/2000 | Guenther et al. | |
| 6,343,539 | B1 | 2/2002 | Du | |
| 6,563,933 | B1 | 5/2003 | Niederdraenk | |
| 6,804,363 | B2 | 10/2004 | Yamasaki et al. | |
| 6,853,735 | B2 | 2/2005 | Imahori et al. | |
| 7,088,839 | B2 | 8/2006 | Geschiere et al. | |
| 7,103,196 | B2 | 9/2006 | Warren | |
| 7,164,776 | B2 | 1/2007 | Miller et al. | |
| 7,302,744 | B1 * | 12/2007 | Huang | 29/25.35 |
| 7,302,748 | B2 * | 12/2007 | Jiles et al. | 29/594 |
| 2001/0012375 | A1 | 8/2001 | Miller et al. | |
| 2002/0136425 | A1 | 9/2002 | Warren | |
| 2002/0146141 | A1 | 10/2002 | Geschiere et al. | |
| 2003/0194102 | A1 | 10/2003 | Yamasaki et al. | |
| 2004/0167377 | A1 | 8/2004 | Schafer et al. | |
| 2004/0168852 | A1 | 9/2004 | Jiles et al. | |
| 2006/0140436 | A1 | 6/2006 | de Moel et al. | |

FOREIGN PATENT DOCUMENTS

| | | | |
|---|---|---|---|
| GB | 1057853 | | 2/1967 |
| WO | WO-00/60902 | A1 | 10/2000 |
| WO | WO-01/87008 | A2 | 11/2001 |

OTHER PUBLICATIONS

International Search Report for PCT/US2003/037397, dated Mar. 25, 2004.

* cited by examiner

SYSTEM OF COMPONENT S USABLE IN THE MANUFACTURE OF AN ACOUSTIC TRANSDUCER

CROSS REFERENCE

This application is a division of U.S. application Ser. No. 10/719,765, filed Nov. 21, 2003, now U.S. Pat. No. 7,302,748, which claims the benefit of U.S. Provisional Patent Application No. 60/428,604, filed Nov. 22, 2002, the disclosure of which is hereby incorporated herein by reference in its entirety for all purposes.

TECHNICAL FIELD

This patent relates to receivers used in listening devices, such as hearing aids or the like, and more particularly, to a diaphragm assembly for use in a vibration-balanced receiver assembly capable of maintaining performance within a predetermined frequency range and a method of manufacturing the same.

BACKGROUND

Hearing aid technology has progressed rapidly in recent years. Technological advancements in this field continue to improve the reception, wearing-comfort, life-span, and power efficiency of hearing aids. With these continual advances in the performance of ear-worn acoustic devices, ever-increasing demands are placed upon improving the inherent performance of the miniature acoustic transducers that are utilized. There are several different hearing aid styles widely known in the hearing aid industry: Behind-The-Ear (BTE), In-The-Ear or All In-The-Ear (ITE), In-The-Canal (ITC), and Completely-In-The-Canal (CTC).

Generally speaking, a listening device, such as a hearing aid or the like, includes a microphone portion, an amplification portion and a receiver (transducer) portion. The microphone portion picks up vibration energy, i.e., acoustic sound waves in audible frequencies, and creates an electronic signal representative of these sound waves. The amplification portion takes the electronic signal, amplifies the signal and sends the amplified (e.g. processed) signal to the receiver portion. The receiver portion then converts the amplified signal into acoustic energy that is then heard by a user.

Conventionally, the receiver portion utilizes moving parts (e.g. armature, diaphragm, etc) to generate acoustic energy in the ear canal of the individual using the hearing aid or the like. If the receiver portion is in contact with another hearing aid component, the momentum of these moving parts will be transferred from the receiver portion to the component, and from the component back to the microphone portions. This transferred momentum or energy may then cause spurious electrical output from the microphone, i.e., feedback. This mechanism of unwanted feedback limits the amount of amplification that can be applied to the electric signal representing the received sound waves. In many situations, this limitation is detrimental to the performance of the hearing aid. Consequently, it is desirable to reduce vibration and/or magnetic feedback that occurs in the receiver portion of the hearing aid or the like.

U.S. patent application Ser. No. 09/755,664, entitled "Vibration Balanced Receiver," filed on Jan. 5, 2001, now U.S. Pat. No. 7,164,776, which is a continuation-in-part of U.S. patent application Ser. No. 09/479,134, entitled "Vibration Balanced Receiver," filed Jan. 7, 2000, now abandoned, the disclosures of which are hereby expressly incorporated hereinby reference in their entirety for all purposes, teaches a vibration balanced receiver assembly designed to establish balanced motion, i.e., equal and opposite momentum of the armature and diaphragm in the assembly and the resulting cancellation of reaction forces inside the receiver portion.

Typically, a receiver assembly comprises an armature that drives reciprocating motion, one or more diaphragms, each of whose reciprocating motion displaces air to produce acoustic output, and one or more linkage assemblies that connect the motion of the armature to the diaphragm or diaphragms. A diaphragm may include a structural element, such as a paddle, that provides the diaphragm with a substantial majority of its mass and rigidity. The paddle is attached to the receiver assembly (aside from its connection to a linkage) by a structure that permits the paddle reciprocating motion to displace air, thereby creating acoustic energy. For example, the paddle may be attached at one of its edges via the structure to some other support member of the receiver. The armature, in contrast, may be attached rigidly to the receiver assembly, so that the motion of the armature involves bending of the armature.

In the case of a vibration balanced receiver, the linkage or linkages connecting the armature and the paddle or paddles may be of a motion-redirection type (such as a linkage, as discussed and described in the afore-mentioned U.S. Pat. No. 7,164,776 and U.S. patent application Ser. No. 09/479,134) so that the velocities of the armature and paddle may be in different directions at their respective points of connection to the linkage. In the context of a motion-redirecting linkage, the method of vibration balancing is to adjust the mass or masses of the paddle or paddles until the total momentum of the diaphragm or diaphragms becomes substantially equal and opposite to that of the armature.

In general, a motion-redirection linkage may either amplify or reduce the magnitude of velocity at its point of attachment to the paddle in comparison to the magnitude of velocity at its point of attachment to the armature. That is, a linkage may constrain the ratio of paddle velocity to armature velocity at a value which is not 1:1, but rather any chosen value within an appreciable range, for example, as high as 10:1 and as low as 1:10. In such cases, since total momentum is the physical quantity to be reduced in the receiver assembly, and since the momentum of a paddle is the product of its mass and velocity, the target value of the mass of a paddle may be different than the mass of the armature. Nonetheless, achievement of a given degree of vibration balancing in a receiver requires that the mass of the paddle must be controlled with precision to a certain value. The masses of diaphragm components other than the paddle or paddles could conceivably also be adjusted, although the characteristics of the other diaphragm components are typically constrained by other acoustic performance requirements. Likewise, the armature mass could conceivably also be adjusted for the purpose of vibration balancing, although once again armature mass is typically not free to be changed in a receiver because that would impact other performance characteristics.

The extent of success of this vibration-balancing method is at least in part reliant on the consistency with which the paddle moves as a hinged rigid body. When a known paddle is used, the vibration-balancing method succeeds only at frequencies below about 3.5 KHz due to insufficient rigidity of the paddle. When the known paddle is driven at higher frequencies, it begins to bend appreciably, especially near 7.5 KHz where the known paddle undergoes a mechanical resonance involving bending of the paddle. This resonant bending changes the proportionality between paddle velocity at the linkage assembly attachment point and the associated diaphragm momentum. The result is an upset of the balance of armature momentum and total diaphragm momentum. The value of paddle resonant frequency (7.5 KHz in the case of the known paddle) is a direct indication of adequacy of paddle rigidity.

The motion-redirection linkage may be realized as a pantograph assembly that utilizes motion of the armature to create motion of the diaphragm that is equal and opposite to that of the armature. The linkage assembly is may be formed from a thin foil because of the low mass, high mechanical flexibility and low mechanical fatigue characteristics that result. The linkage assembly must also satisfy geometric tolerance criteria, both because it must accomplish precise motion-reversal for the purpose of vibration balancing and because it must fit properly between the armature and diaphragm. Early development of the receiver design relied on manually fabrication of the linkage assembly, originally from a photo-patterned foil blank (as shown in FIG. 6A). Through multiple manual folding steps, the diamond leg linkage assembly may be formed (as shown in FIG. 6B). The manual formation of the linkage proved to be unacceptable in terms of throughput and part quality. Due to natural variations inherent to the manual process, unacceptable levels of bending and distortion were present in the majority of the formed piece parts. The manual process throughput was poor due to the high number and complexity of the forming operations required.

DETAILED DESCRIPTION

Figure 1:
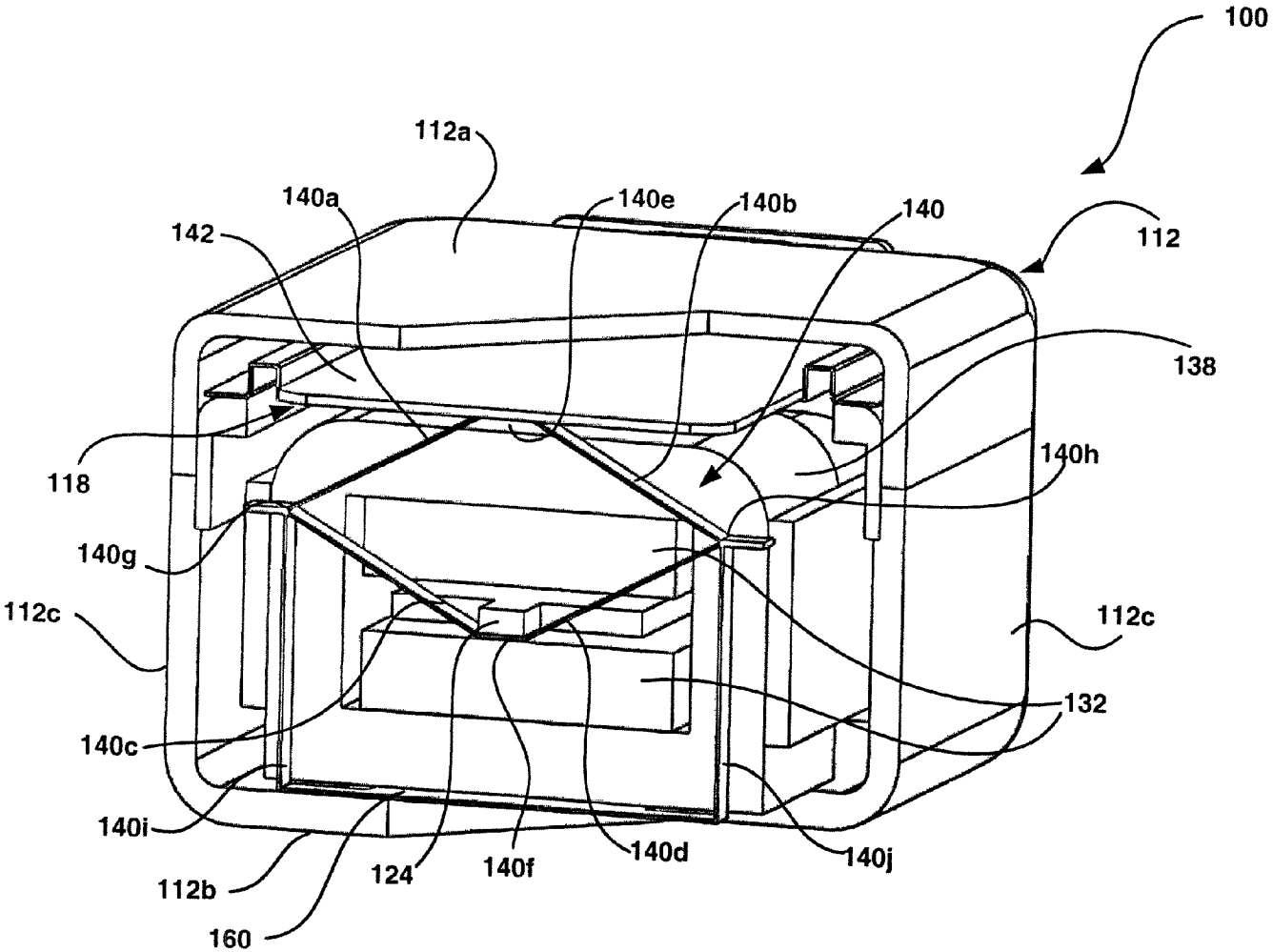
FIG. 1 is a diagram of a linkage assembly utilized in a vibration balanced receiver assembly of one of the described embodiments.

While the present invention is susceptible to various modifications and alternative forms, certain embodiments are shown by way of example in the drawings and these embodiments will be described in detail herein. It should be understood, however, that this disclosure is not intended to limit the invention to the particular forms described, but to the contrary, the invention is intended to cover all modifications, alternatives, and equivalents falling within the spirit and scope of the invention defined by the appended claims.

As will be appreciated from the following description of embodiments, a vibration balanced receiver assembly may include a housing for the receiver. The housing may have a sound outlet port. One or more diaphragms, each including a paddle may be disposed within the housing, each paddle having at least one layer. An armature is operably attached to a one or more linkage assemblies. Each such linkage assembly is operably connected to the one or more diaphragms to provide an acoustic output of the receiver assembly in response to movement of the armature. Each linkage assembly is capable of converting motion of the armature in one direction to motion of a diaphragm in another direction that may be different than the direction of armature motion. The relative magnitudes and directions of armature and diaphragm motion, as well as the moving masses or inertial masses of the armature and one or more paddles, are chosen so that the momentum of the armature becomes substantially equal and opposite to the total momentum of all of the diaphragms.

In order to maintain a given degree of vibration balancing over the frequency range of the hearing aid system, the lowest frequency of paddle resonance involving bending of the paddle must be at or above a frequency which stands in a certain ratio to the maximum frequency at which amplification is applied by the hearing aid system. The ratio of minimum paddle resonant frequency to hearing aid system maximum frequency depends on the degree of vibration balancing which is to be achieved. Achievement of relatively complete vibration balancing corresponds to higher minimum values of the frequency ratio. As a particular example, if 90% vibration balancing is required, i.e. a maximum allowable net residual unbalanced momentum in the amount of 10% of the original armature momentum, the frequency ratio must be at least 2:1. Continuing this example, current hearing aid systems used to address mild hearing impairment apply amplification up to about 7 KHz, which implies that in order to provide 90% vibration balancing over the frequency range of the hearing aid system, a paddle whose its lowest paddle bending resonant frequency is 14 KHz or higher is required.

Paddle Structure

FIG. 1 illustrates one embodiment and components of a receiver 100. The receiver 100 includes a housing 112 having at least one sound outlet port (not shown). The housing 112 may be rectangular in cross-section, with a planar top 112*a*, a bottom 112*b*, and side walls 112*c*. Of course, the housing 112 may take the form of various shapes (e.g. cylindrical, D-shaped, or trapezoid-shaped) and have a number different of sizes. The receiver assembly 100 further includes a diaphragm 118, an armature 124, drive magnets 132, magnetic yoke 138, a drive coil (not shown), and a linkage assembly 140. One of skill in the art will appreciate the principles and advantages of the embodiments described herein may be useful with all types of receivers, such as those with U-shaped or E-shaped armatures.

The diaphragm 118 and the armature 124 are both operably attached to the linkage assembly 140. In other embodiments, more than one diaphragm may be used in the receiver 100. The diaphragm 118 includes a paddle 142 and a thin film (not shown) attached to the paddle 142. The paddle 142 is shown to have at least one layer. However, the paddle 142 may utilize multiple layers, and such embodiments will be discussed in greater detail. The linkage assembly 140 is shown generally quadrilateral, having a plurality of members 140*a*, 140*b*, 140*c*, 140*d* and vertices 140*e*, 140*f*, 140*g*, 140*h*. The linkage assembly 140 may take the form of various shapes (e.g.

elliptical-like shape such as an elongated circle, oval, ellipse, hexagon, octagon, or sphere) and having an ellipticity of varying deviations. The members 140*a*, 140*b*, 140*c*, 140*d* are shown substantially straight and connected together at the vertices 140*e*, 140*f*, 140*g*, 140*h*. The transitions from one member to its neighbor may be abrupt and sharply angled such as vertices 140*g*, 140*h*, or may be expanded and include at least one short span, such as vertices 140*e*, 140*f*.

The armature 124 is operably attached to the linkage assembly 140 at or near the vertex 140*f*. The paddle 142 is operably attached to the linkage assembly 140 at or near the vertex 140*e* by bonding or any other suitable method of attachment. The motion of vertices 140*g* and 140*h* of the linkage assembly 140 is partially constrained by legs 140*i* and 140*j* of the linkage assembly 140, thus restricting movement of the vertices 140*g* and 140*h* in a direction parallel to the orientation of a first and second leg 140*i*, 140*j*. As an example, upward vertical movement by the armature 124 generates a purely horizontal outward movement of vertices 140*g*, 140*h*, resulting in downward vertical movement of the paddle 142. The opposing motions of the armature 124 and diaphragm 118 enables the vibration balancing of the receiver 100 over a wide frequency range. The insertion point 160 is described below.

Typically, the available space within the receiver housing in the vicinity of the paddle is limited by constraints on the overall size of the receiver housing. As described in the above-mentioned U.S. Pat. No. 7,164,776 and U.S. patent application Ser. No. 09/479,134, the motion-redirection linkage may be realized as a pantograph assembly that utilizes motion of the armature to create motion of the diaphragm that is equal and opposite to that of the armature. The linkage assembly may be formed from a thin foil because of the low mass, high mechanical flexibility and low mechanical fatigue characteristics that result. The linkage assembly must also satisfy geometric tolerance criteria, both because it must accomplish precise motion-reversal for the purpose of vibration balancing and because it must fit properly between the armature and diaphragm.

Figure 2:
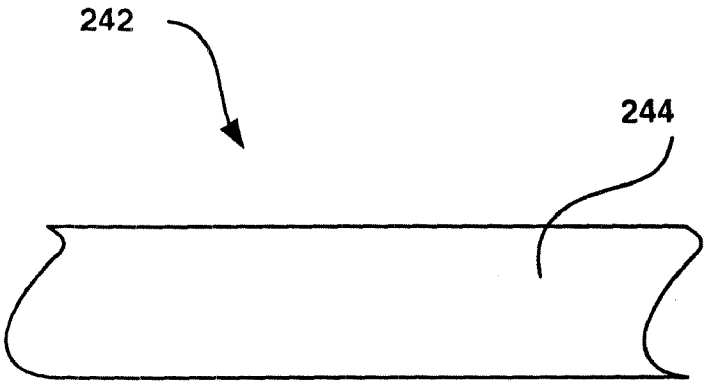
FIG. 2 is a cross-section view of a described embodiment of a single layer paddle.

FIG. 2 is a cross-section view of an example paddle 242 that can be used in a variety of receivers, including receivers similar to the receiver assembly 100 illustrated in FIG. 1. The paddle 242 includes at least one layer 244. The paddle 242 may be designed to have an inertial mass that produces momentum balancing the momentum of the armature 124 (as shown in FIG. 1). The layer 244 may be made of aluminum, in one embodiment having a thickness of approximately 0.010 in. (250 μm), in which case the lowest-frequency bending resonance of a paddle of length 0.25 in. (a typical paddle length) is at a frequency of about 21 KHz. However, any material having sufficient density to create a paddle 242 whose momentum balances the momentum of the armature 124 within the available space of the output chamber and has sufficient rigidity such that the frequency of its first mechanical resonance is beyond the design target, for example, 14 kHz as described above, may be used. For example, titanium, tungsten, or some composites, such as a plastic matrix, fiber reinforced plastic or combinations of these may be able to meet such mechanical requirements.

Figure 3:
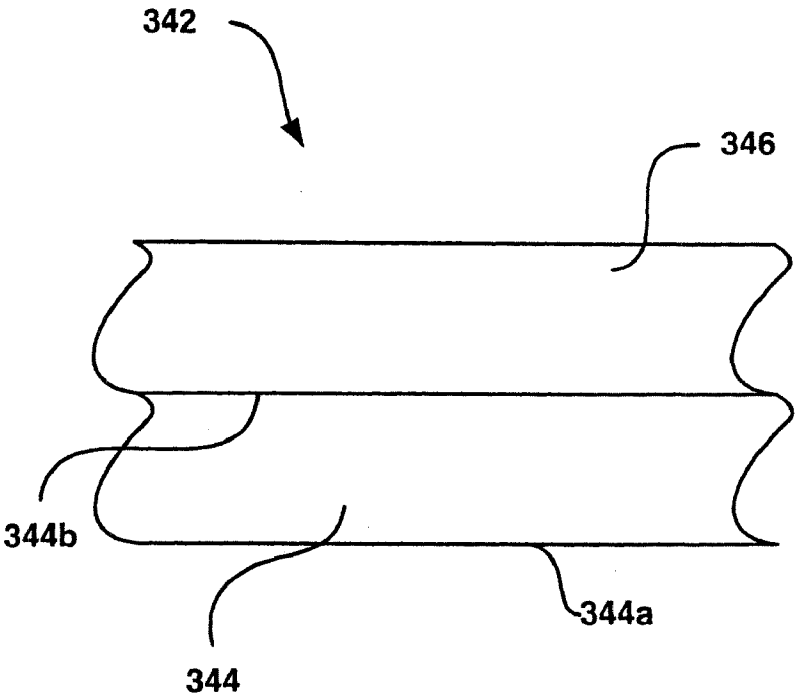
FIG. 3 is a cross-section view of another described embodiment of a two layer paddle.

FIG. 3 is a cross-section view of another example paddle 342 that can be used in a variety of receivers, including receivers similar to the receiver assembly 100 illustrated in FIG. 2. The paddle 342 includes an inner layer 344 and at least one outer layer 346. The inner layer 344 includes a first surface 344*a* and a second surface 344*b*. The outer layer 346 is attached to the second surface 344*b* of the inner layer 344 for example, by bonding with adhesive, compression, or mechanical attachment at the edges. In one example, the inner layer 344 is made of aluminum having a thickness of 0.007 in. (175 μm), and the outer layer 346 is made of stainless steel having a thickness of 0.001 in. (25 μm). In this example, the overall thickness of the paddle is 0.008 in. (200 μm), the paddle mass provides balancing momentum for the momentum of the armature 124 of FIG. 1, the lowest bending resonant frequency is about 18 KHz, and the overall paddle thickness is less than a typical paddle, thereby taking up less space in the output chamber of the receiver 100. It is to be understood that layer thickness and materials other than those described above may be utilized as well. Mechanical stiffening to affect the resonant frequency may also be employed, for example, within the space constraints of the receiver 100, one or both of the layers 344, 346 may have corrugations, curved edges or other edge formations to increase the rigidity and therefore raise the resonant frequency of the paddle. The layers may not be the same size, depending on the ability of the structure to meet the mechanical characteristics required. Similarly, other metals or composites such as titanium, tungsten, platinum, or non-metals such as plastic, plastic matrix, fiber reinforced plastic or multiples of these could provide the needed mechanical properties of inertial mass and resonant frequency, although all may not be practical for all applications due to other considerations, such as cost.

Figure 4:
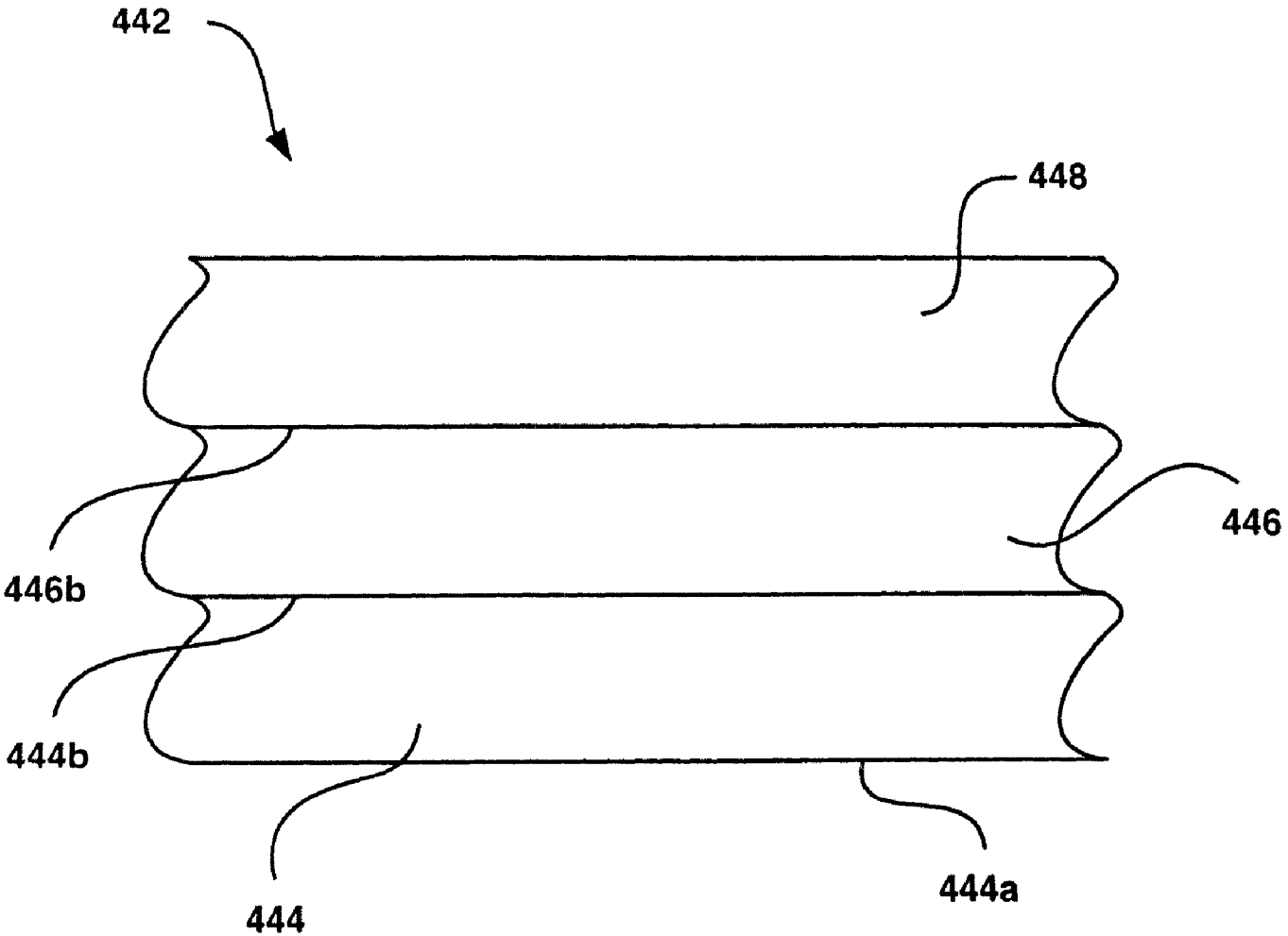
FIG. 4 is a cross-section view of another described embodiment of a plural layer paddle.

FIG. 4 is a cross-section view of another example paddle 442 that can be used in a variety of receivers, including receivers similar to the receiver assembly 100 illustrated in FIG. 1. The paddle 442 includes a first layer 444, a second layer 446, and a third layer 448. The second layer 446 is attached to the first layer 444 at interface 444*b*. The third layer 448 is attached to the second layer 446 at interface 446*b*. The paddle 442 may then be then combined with the other elements (not depicted) of the diaphragm assembly 118 and attached to the linkage assembly 140 shown in FIG. 1. In one example, the first and third layers 444, 448 can be formed from a material of high elastic modulus such as stainless steel, copper, brass, or alloys thereof, or beryllium copper (BeCu) and have a thickness of about 0.0015 in. (37.5 μm). The material of the second layer 446, preferably of a low density such as modified ethylene vinyl acetate thermoplastic adhesive, a thermo set adhesive, an epoxy, or polyimide (Kapton), acts as an adhesive for joining the first and third layers of the structure and to increase the bending moment of the paddle and hence raise the paddle resonant frequency without adding significantly to the mass and has a thickness of 0.003 in. (75 μm) to 0.004 in. (100 μm). The paddle mass results in balancing momentum to the momentum of the armature 124 of FIG. 1, and the multi-layer structure results in a lowest frequency paddle resonance at about 15.3 KHz. The overall thickness of the paddle 442 can be as low as 0.006 in. (150 μm) thus requiring less space in the output chamber of the receiver. It is to be understood that the thickness and materials other than those described above may be utilized as well. For example, the thickness of the first and third layers 444, 448 may be 10% to 200% of the thickness of the second layer 446, as long as the paddle 442 satisfies the constraints on momentum balancing and frequency of bending resonance. The manufacture of the paddle 142 may include assembling sheets of first and third layers with the second layer disposed on the surface 444*b* of the first layer or the surface of the third layer 446*b*. The second layer, if an adhesive, may be disposed by screening or spinning techniques to achieve a uniform thickness. In one embodiment, the assembled sheets are cured and then the individual paddles 142 are laser scribed from the sheet and attached to the other diaphragm components for assembly into the receiver 100. Other separation techniques are known in the art, such as stamping. Stamping with customized tooling may be used if edge bends are used for stiffening the assembly.

The selection of a minimum resonant frequency is determined by the application and the supporting electronics. In some embodiments, where the application does not require wide frequency range, a resonant frequency above 7.5 KHz may be satisfactory. In other applications a resonant frequency above 14 KHz may be required. In still other applications, the electronics of the receiver may provide for easy limiting of feedback above a given frequency, either by specific notch filters or simply as a result of amplifier roll off at or above the resonance frequency. The adaptation of such filters and amplifier gain over frequency to meet these goals can be achieved by a practitioner of ordinary skill without undue experimentation.

Figure 5:
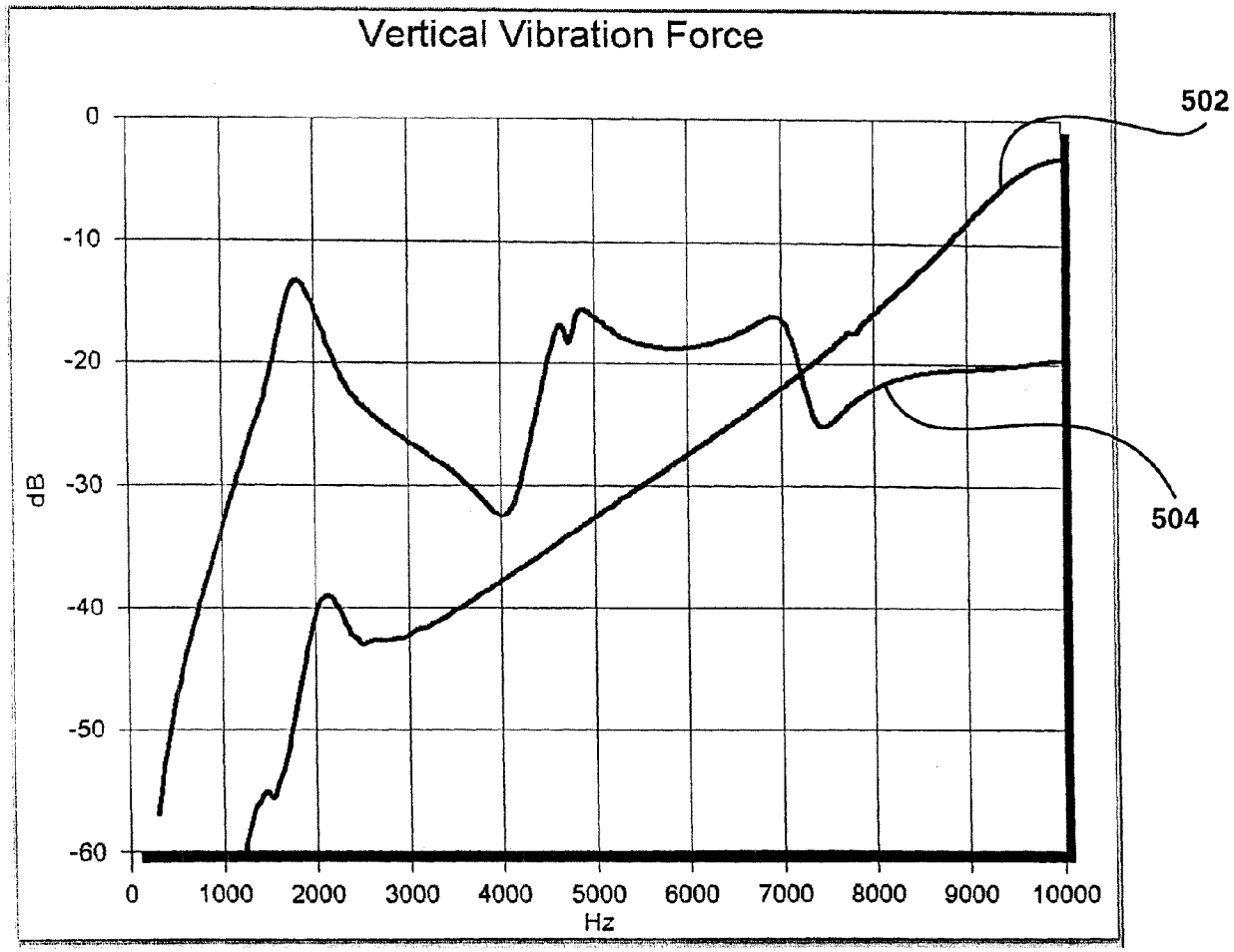
FIG. 5 is a graph of the vertical vibration force as a function of frequency level.

FIG. 5 is a graph which compares the vertical vibration force per unit current excitation of the receiver coil 502 for a vibration-balanced receiver comprising a paddle of a type shown in FIG. 4 to that of a conventional non-vibration-balanced receiver 502, as a function of excitation frequency. The graph indicates that the vertical vibration force is improved (i.e. reduced) at all frequencies up to 7 KHz.

Pantograph Linkage Assembly

Figure 6B:
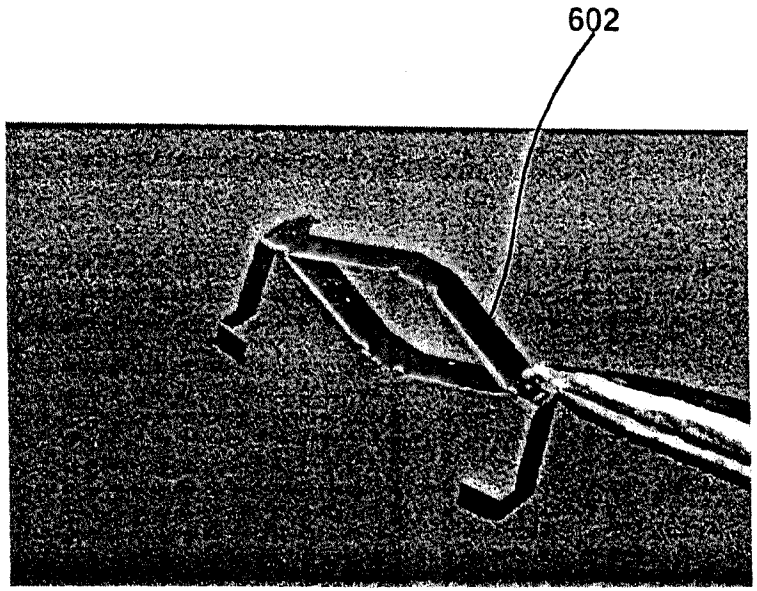
FIG. 6B is a diagram showing the linkage assembly from the manually folded foil blank.
Figure 6A:
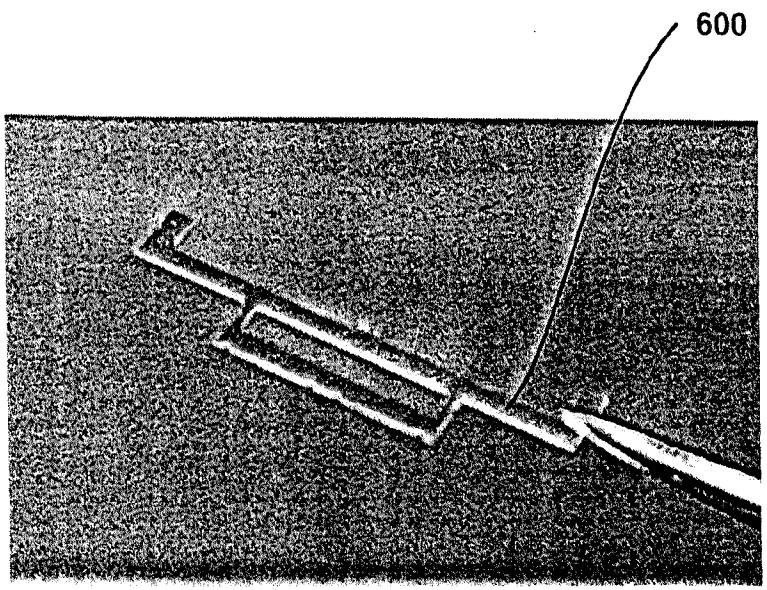
FIG. 6A is a diagram showing a photo patterned foil blank for manual fabrication of a linkage assembly.

FIGS. 6A and 6B are diagrams illustrating a photopatterned foil blank 600 and finished linkage assembly 602 using the foil blank 600. Early development of the receiver design relied on manually fabrication of the linkage assembly 602, originally from a photopatterned foil blank 600 as shown in FIG. 6A. Through multiple manual folding steps, the diamond leg linkage assembly 602 is formed as shown in FIG. 6B. The manual formation of the linkage proved to be unacceptable in terms of throughput and part quality. Due to natural variations inherent to the manual process, unacceptable levels of bending and distortion were present in the majority of the formed piece parts. The manual process throughput was poor due to the high number and complexity of the forming operations required.

Apart from the pursuit of miniaturization, it is desirable to enable the manufacture of the structure of the linkage assembly to be as inexpensive as possible and further reduce the labor component for high volume production.

Figure 7B:
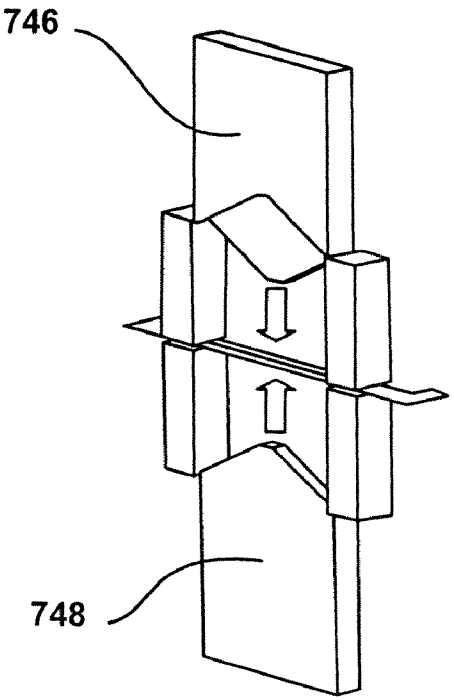
FIGS. 7A-7C are diagrams showing a sequence of manufacturing steps in one described embodiment for forming a linkage assembly.
Figure 7A:
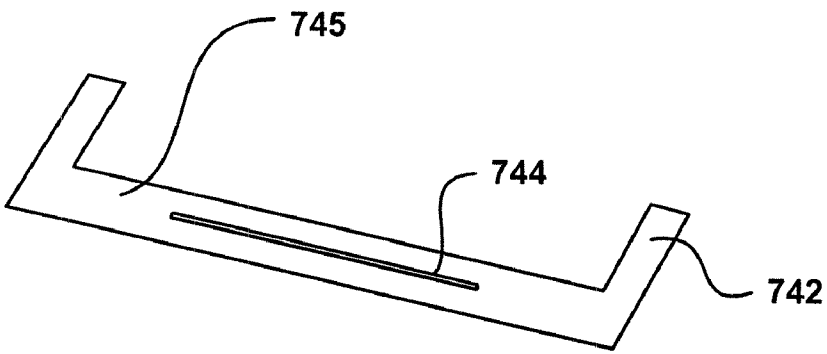
Figure 7D:
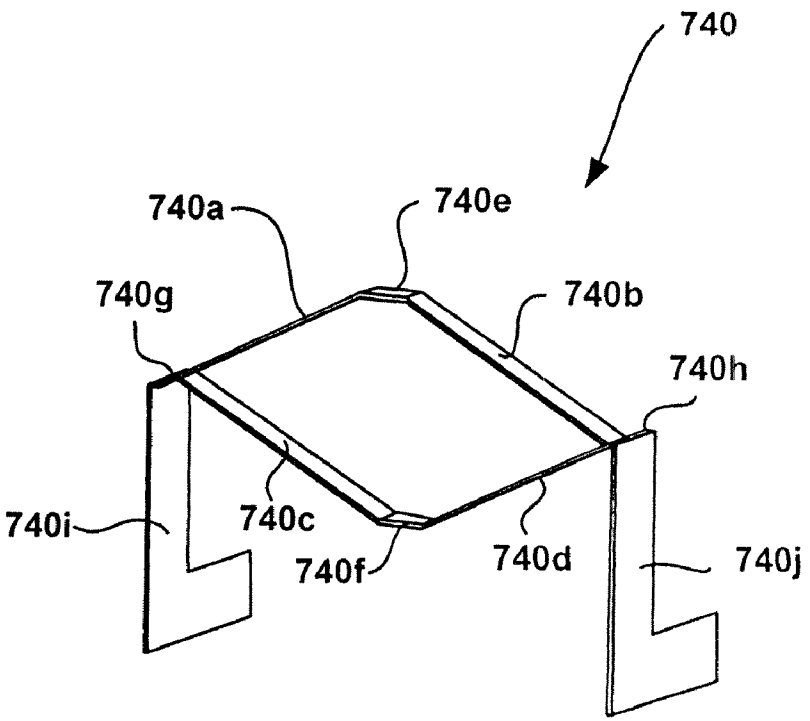
FIG. 7D is a diagram showing a finished linkage assembly fabricated by utilizing the steps illustrated in FIGS. 7A-7C.
Figure 7C:
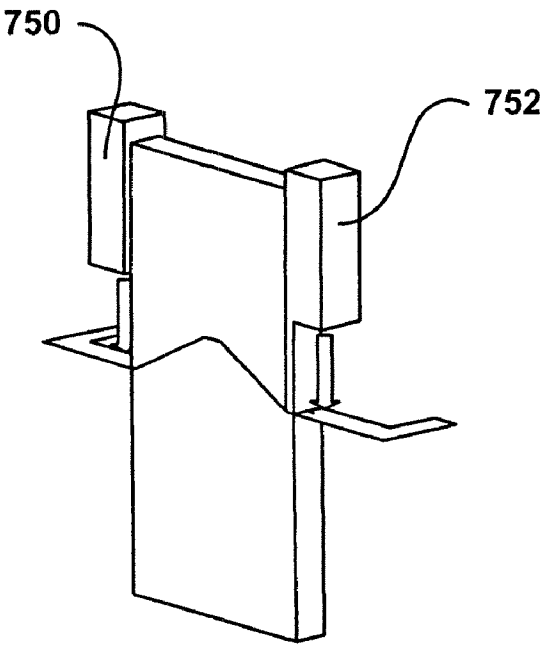

FIGS. 7A to 7D show a sequence of manufacturing processes, leading to FIG. 7D, where is shown linkage assembly 740. The linkage assembly 740 is typically fabricated from a flat stock material such as a thin strip of metal or foil 742 having a surface 745 that defines a plane, a width and a longitudinal slit 744 in the center region of the strip 742 as shown in FIG. 7A. Alternately, the linkage assembly 740 may be formed of plastic or some other material. A "diamond" portion of the linkage assembly is formed in a single forming operation using two complementary shaped dies 746, 748 that displace first and second portions of the strip 742 relative to the plane. That is, the dies 746 and 748 separate and bend the foil material on either side of the slit 744 to form the members 740*a*, 740*b*, 740*c*, 740*d* and vertices 740*e*, 740*f*, 740*g*, 740*h* of the pantograph "diamond" portion as shown in FIG. 7D. The area of the blank not formed at this step, i.e. the portion outside of the center region, is guided, but not clamped by blocks 750, 752 adjacent to the stamping dies. Referring to FIG. 7C, the "diamond" portion is captivated by the two complementary stamping dies 746, 748. The first and second legs 740*i*, 740*j* are formed by sliding the two upper guide blocks 750, 752 downward. The linkage assembly 740 is completed and is ready to be mounted into a receiver. The linkage assembly 740 may then be then fastened to corresponding surfaces (not depicted) of the receiver assembly 100 within the housing 112.

Figure 8B:
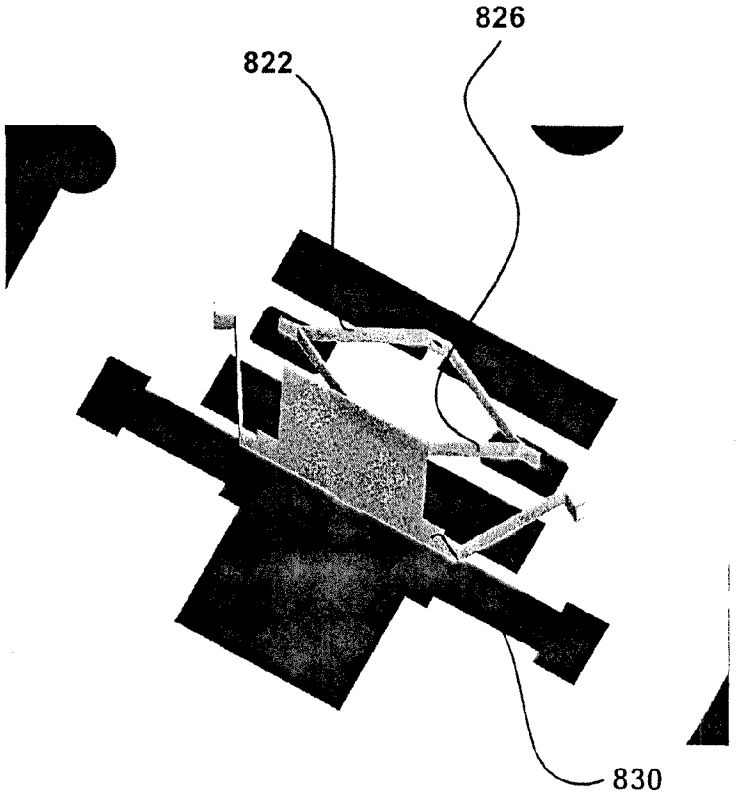
FIGS. 8A-8F are diagrams showing a sequence of manufacturing steps in another described embodiment for forming a linkage assembly.
Figure 8A:
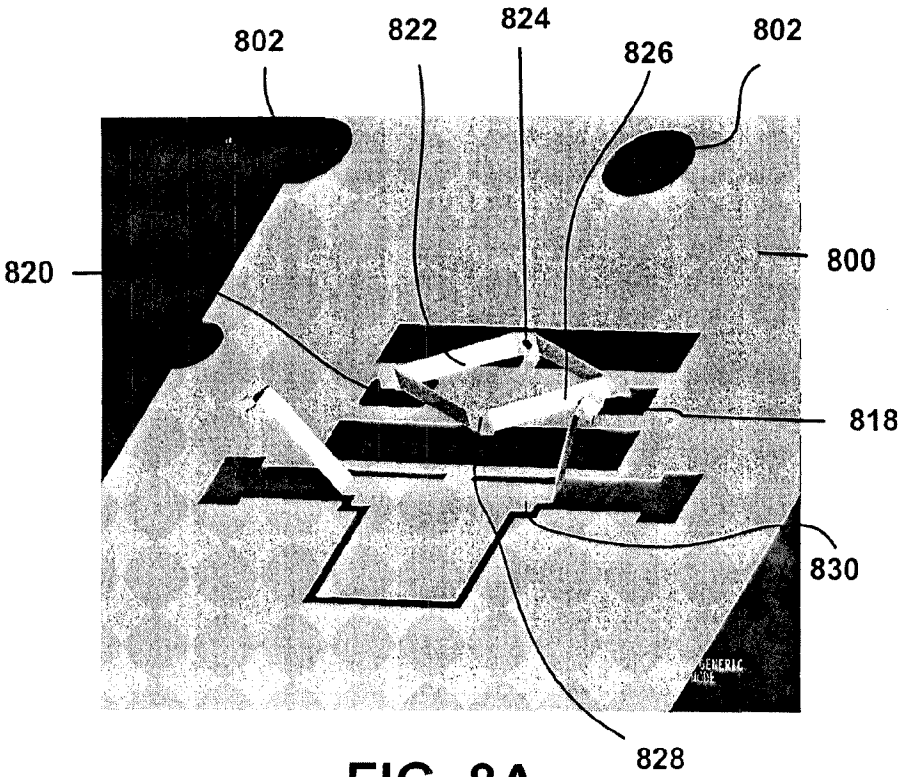
Figure 8D:
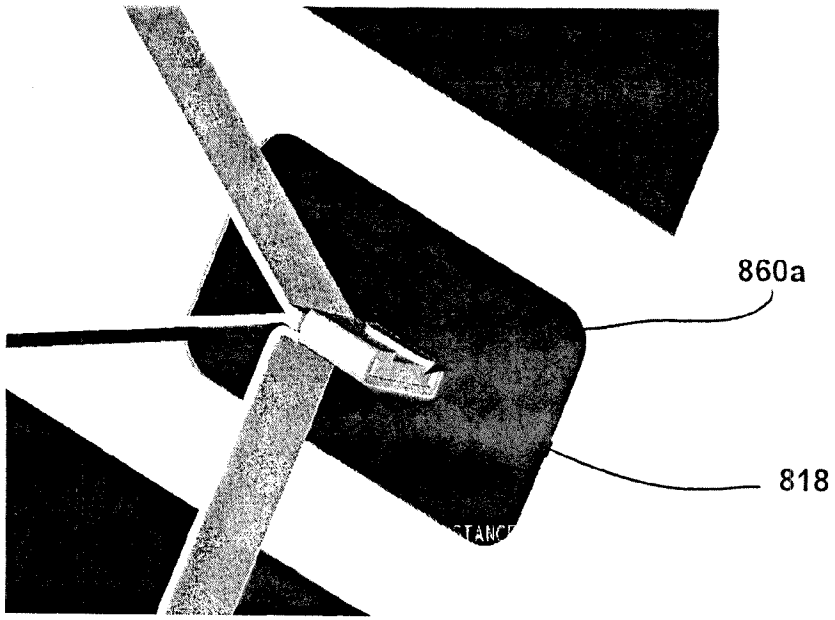
Figure 8C:
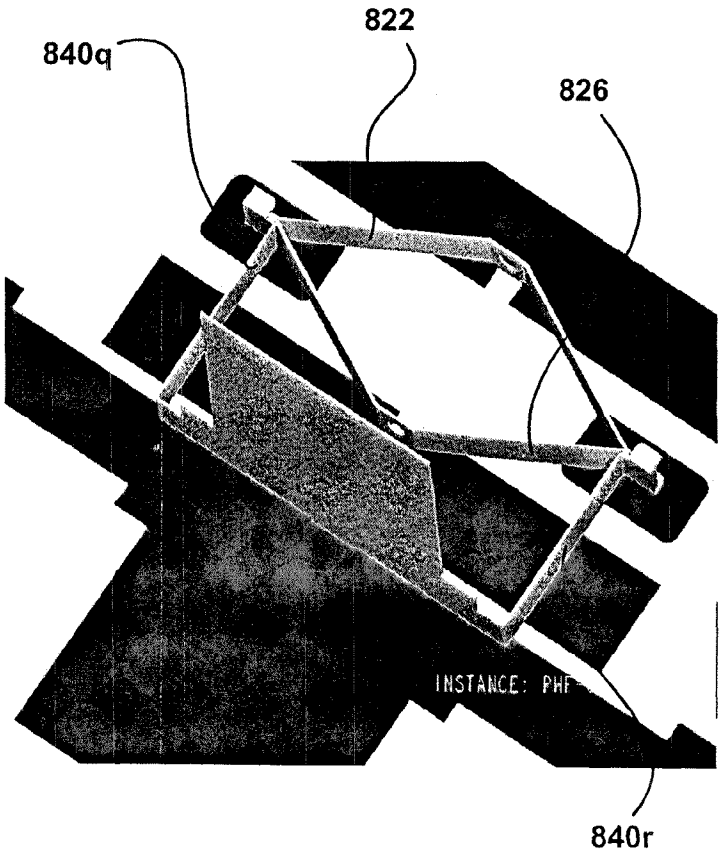
Figure 8F:
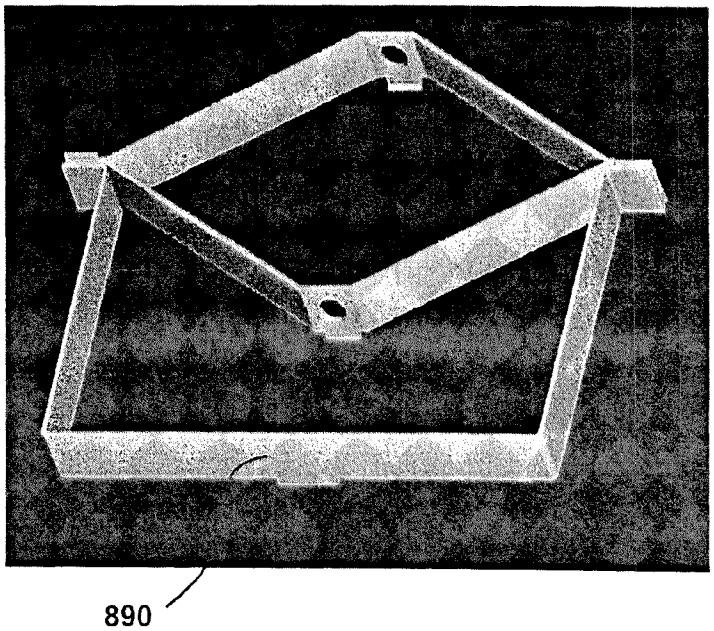

FIGS. 8A to 8F show a blanking and forming sequence of manufacturing processes using progressive dies, particularly to FIG. 8F, there is shown the linkage assembly 840 that may be used in a receiver such as the receiver 100 shown in FIG. 1. Progressive dies have long been known in the art. Progressive die fabrication operations are typically performed on starting stock material having a continuous form such as a ribbon or strip. Sequential stations are used for operations such as stamping of ribs, bosses, etc. on the blank surfaces, for cutting, shearing or piercing of the material to create needed holes, slits or overall shape, and/or for folding the material to create a general three dimensional shape. The continuous form of the starting stock material allows partially developed individual parts, still attached to the stock material, to be collectively carried from station to station without requiring handling and locating of individual parts. Each stamping station will thus have specifically configured, but otherwise generally, conventional punch/die assemblies that cooperate to achieve the above noted and possible other fabricating procedures. Laser blanking, cutting, shearing, or piercing may also be used in conjunction with the progressive die stamping process.

FIG. 8A shows a perspective view of flat stock material 800 such as foil blank, partially processed, for example, by a progressive die machine (not shown), as discussed above. The flat stock material 800 defines a plane. A plurality of punch and die features 802, and 818-820 are shown. The punch and die components 802, 818-820 are required for propagation thru the die and to provide access for a subsequent laser operation after linkage assembly 140 forming is complete. A first preform 822 and a first hole 824 punched in the center region of the preform 822 are as shown. An opposing second preform 826 and a second hole 828 punched in the center region of the preform 826 is also shown. The first preform 822 displaced relative to the plane. The second preform 826 is displaced relative to the plane similarly plastically deforming the preform 826 into a second linkage member with a half-diamond configuration. A third preform 830 is shown. In one embodiment the preforms 822, 826, and the leg portion of 830 are the same width.

Figure 8E:
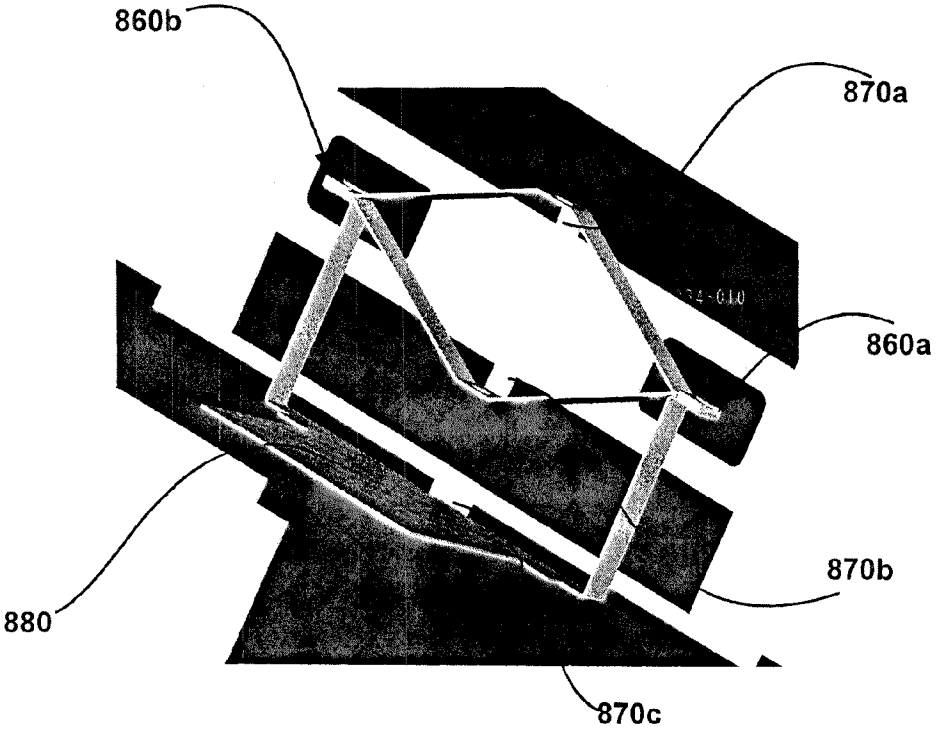

The "diamond shape" of the linkage assembly 140 is formed during 90 deg bending operations of the first and second preforms 822, 826. A first bending operation is performed on the third preform 830 to rotate the linkage assembly support legs into a plane with the "diamond shape" as shown in FIG. 8B. FIG. 8C shows the support legs 840*q* and 840*r* rotated into alignment with the first and second preforms 822, 826. As shown in FIGS. 8D and 8E, crimp structures 860*a* and 860*b* provide mechanical coupling of the first, second and third preforms 822, 826 and 830 to secure the assembly. The crimp structures 860*a* and 860*b* provide both mechanical support to the structure in operation and stabilize the assembly until the welding, adhesive bonding, or other mechanical coupling such as riveting or fastening are completed. Alternatively, the attachment force within the crimp structures 860*a*, 860*b* alone may be relied on to provide the mechanical integrity needed for linkage assembly operation within the finished receiver. FIG. 8D shows the crimp structure and the dimensional relationship between laser access opening 818 and crimp structure 860*a*. A laser beam, such as used for welding, may pass without interference through the plane of the material strip 800 in order to access the crimp structure 860*a*. The embodiment shown in FIG. 8E also has a mounting surface 880 for use in assembly in the receiver 100.

Figure 9:
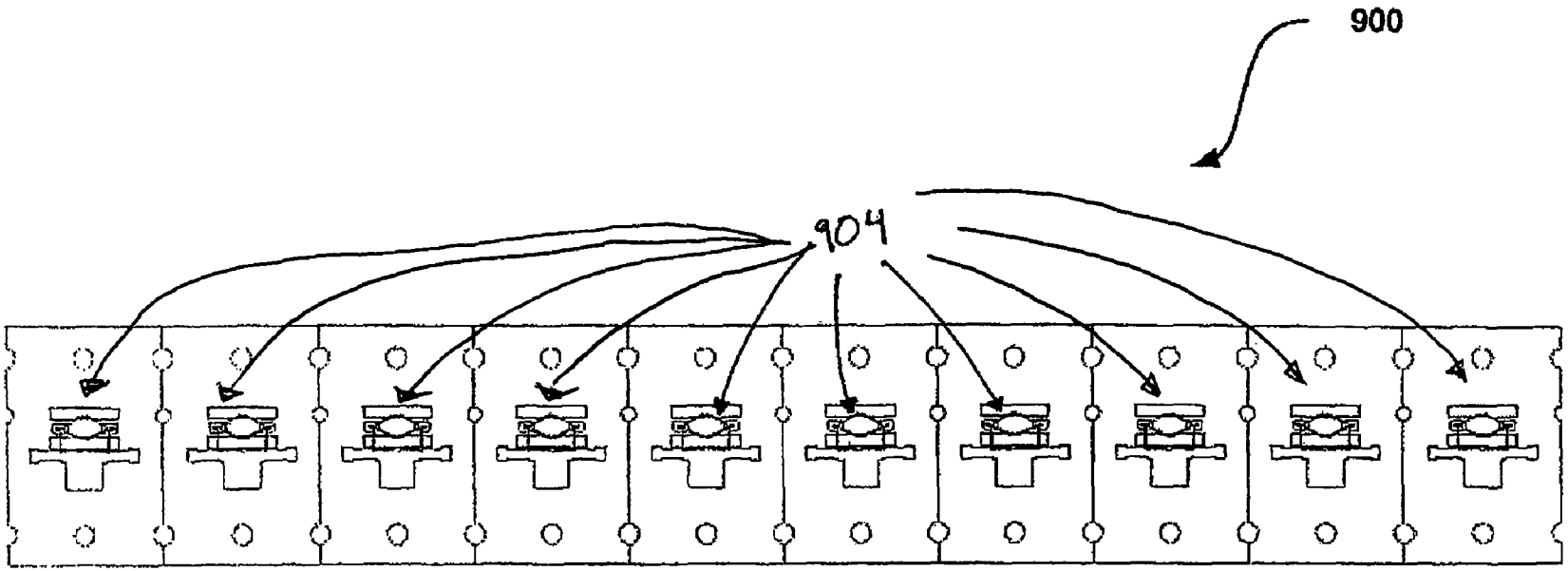
FIG. 9 is a representation of a film carrying a plurality of formed linkage assemblies.

The completed linkage assembly 140 may then be cut from the support strip by removing or cutting the respective preform 822, 826, 830 support members 870*a*, 870*b* and 870*c*. Optionally, the linkage assembly 140 may be left attached for additional receiver assembly processes using the flat stock material 900. The stock may also be segmented into a predetermined number of linkage assemblies as shown in FIG. 9. It should be noted that none of the bends used to form the linkage assembly 140, or any section thereof are more than 90 deg. Moreover, no free leg of a preform has more than two bends prior to final positioning and fastening. This simplifies the progressive die tooling and improves dimensional accuracy by reducing compound errors in forming features. It also reduces stress introduced at the bend points that may later cause failure due to metal fatigue.

FIG. 9 is a diagram illustrating a strip 900 where the original stock material is maintained and used as a carrier system for a plurality, i.e., 10 as shown, linkage assemblies 904, formed in one example as shown in FIGS. 8A-8E. Subsequent assembly operations using the strip 900 are performed in an array process. Utilizing the strip 900 form can increase throughput and reduce the chance for damage to linkage assemblies 904 due to individual part handling. In operation, the strip 900 is disposed near and aligned with a corresponding array of receiver housings 112 (as shown, for example, in FIG. 1). The strip 900 is moved into place against the receiver housing 112, allowing the assembly tab 880 (for example, as shown in FIG. 8E) to slide into a corresponding slot 160 in another component of the receiver 100. A weld can be performed or an adhesive wicked into the slot/tab 160,880 assembly. Optionally, the armature 124 and diaphragm 118 may be present at the time the linkage assembly tab 880 is inserted, without mechanical interference. The armature 124 and diaphragm 118 may be secured to the linkage assembly 904 in the same operation by laser welding or by adhesive application. After each linkage assembly 904 in the strip 900 is secured to its respective receiver subassembly by at least one connection, the linkage assembly 904 may then be separated from the strip 900 by severing the connecting members 870*a*, 870*b* and 870*c* (for example, as shown in FIG. 8E). In one embodiment, the same laser used for welding each linkage assembly attachment tab 880 to its receiver subassembly is used for cutting the respective linkage assembly 904 from the strip 900.

The particular embodiment of the progressive die method which is shown in FIG. 8A to FIG. 8Q is not meant to restrict the scope of the invention. For example, FIG. 8R shows an alternate form of a linkage assembly 740 which can be fabricated using the progressive die method, in which the attachment tab 880 is not present. Such an embodiment of the linkage assembly may be attached to the receiver 100 by welding or otherwise bonding the pantograph base 890 to the bottom 112*b* of housing 112.

Figure 10D:
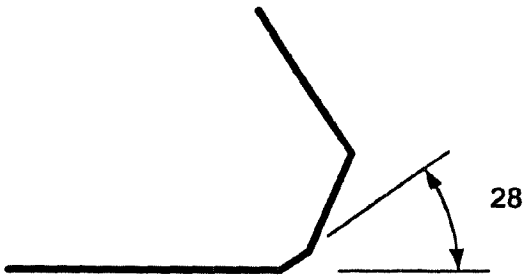
FIGS. 10A-K are cross-section views showing the manufacturing steps for another described embodiment for forming a linkage assembly.
Figure 10E:
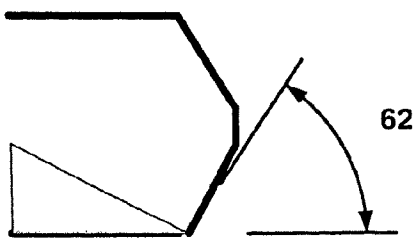
Figure 10A:
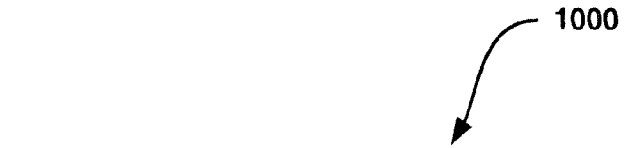
Figure 10B:
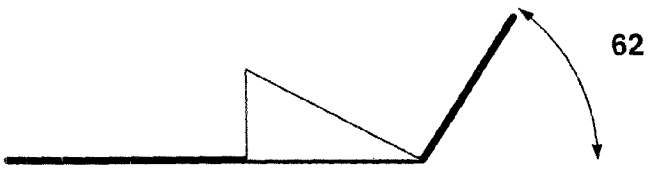
Figure 10C:
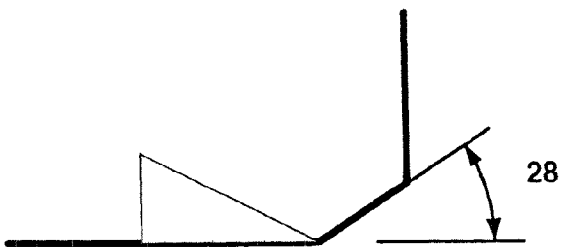
Figure 10F:
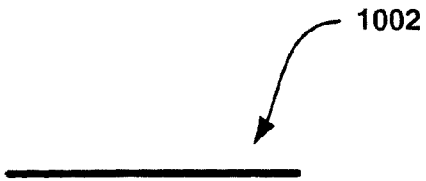
Figure 10G:
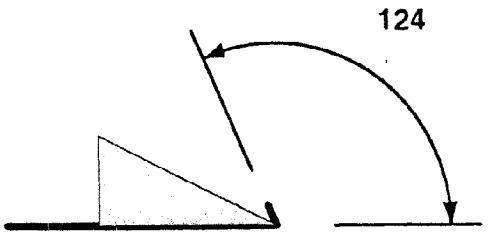
Figure 10H:
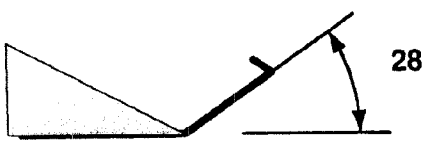
Figure 10I:
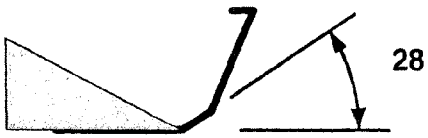
Figure 10J:
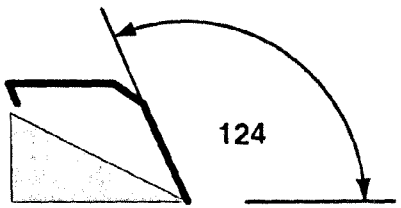
Figure 10K:
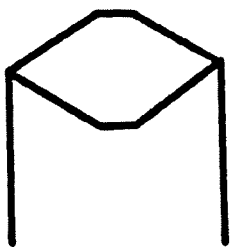

FIGS. 10A-K are cross section views showing the bending sequence of the linkage assembly on another embodiment of the present invention. Sections 1000 and 1002 are selected from a metal or other material with suitable memory and elasticity to support the operation of the receiver, that is, it must be able to transmit energy from the armature 124 to the diaphragm 118 at thousands of cycles per second over the lifetime of the receiver 100, in many cases for years. The starting material is in the form of a strip of width equal to the desired finished width of pantograph members 140*a*, 140*b*, 140*c*, 140*d* as shown in FIG. 1. FIG. 10A shows the construction of a first section 1000. The construction of a second section 1002 is shown in FIG. 10F. The first section 1000 is formed by progressive bends to form the legs and top structure of the linkage assembly 140. The second section 1002 may also be formed by progressive bends. The exact angles of each bend are determined by the distance between the diaphragm 118 and the armature 124, the width of the linkage assembly 140 and the length of the linkage assembly 140 support legs 140*i*, 140*j*. The determination of the angles and bend requirements are easily developed by one of ordinary skill in the art. In FIG. 10B, a first bend of approximately 62 deg. is made, defining a first leg. As shown in FIG. 10C, a second bend of approximately 28 deg is made defining a first portion of the top of the linkage assembly 140. As shown in FIG. 10D, a bend of approximately 28 deg is made forming the diaphragm 118 connection surface. FIG. 10E shows a final bend of approximately 62 degrees, forming the second portion of the top of the linkage assembly 140 and the second support leg. The second section 1002 is formed by a first bend of approximately 124 deg as shown in FIG. 10G creates a mounting tab. A second bend of approximately 28 deg, shown in FIG. 10H forms a first bottom portion of the linkage assembly 140. A third bend of approximately 28 deg forms a portion corresponding to the diaphragm connection surface of the top of the linkage assembly. FIG. 10J shows a final bend of approximately 124 deg for forming the second mounting tab. The assembly 1002 is placed between the leg structures of 1000 to form the linkage assembly 140 and connected by a weld or adhesive, as shown in FIG. 10K. While this construction method creates an effective and useful linkage assembly 140, cumulative errors in bend angle and bends greater than 90 deg can result in undesired variability, yield loss and mechanical stress to the parts.

All references, including publications, patent applications, and patents, cited herein are hereby incorporated by reference to the same extend as if each reference were individually and specifically indicated to the incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. It should be understood that the illustrated embodiments are exemplary only, and should not be taken as limiting the scope of the invention.

What is claimed is:

1. A system of components usable in the manufacture of an acoustic transducer, the system comprising:

a strip, the strip including a substrate having formed therein a plurality of first transducer assembly components, the first transducer assembly components being supported by the strip;

a plurality of second transducer assembly components, the second transducer assembly components being arranged in an array such that at least one second transducer assembly component is aligned with and secured to a corresponding first transducer assembly component supported by the strip;

wherein each of the plurality of first transducer assembly components comprises a linkage assembly;

wherein each of the plurality of second transducer assembly components comprises one of a receiver housing, an armature, a diaphragm or a receiver subassembly;

wherein each second transducer assembly component is welded, bonded or mechanically fastened to the corresponding first transducer assembly component.

2. The system of components of claim 1, wherein the first transducer assembly components are supported by the strip in a spaced relationship.

3. The system of components of claim 1, wherein the strip comprises alignment features.

4. The system of components of claim 1, each of the second transducer assembly component comprising an assembly feature, the assembly feature engaging a corresponding assembly feature associated with the corresponding first transducer assembly component.

5. The system of components of claim 1, wherein the strip is formed with a plurality of assembly access apertures.

* * * * *

UNITED STATES PATENT AND TRADEMARK OFFICE

CERTIFICATE OF CORRECTION

PATENT NO. : 7,921,540 B2
APPLICATION NO. : 11/552216
DATED : April 12, 2011
INVENTOR(S) : Mekell Jiles and David Earl Schafer It is certified that error appears in the above-identified patent and that said Letters Patent is hereby corrected as shown below:

ON THE COVER PAGE Item 54:
Delete the Title "SYSTEM OF COMPONENT S USABLE IN THE MANUFACTURE OF AN ACOUSTIC TRANSDUCER" and insert -- SYSTEM OF COMPONENTS USABLE IN THE MANUFACTURE OF AN ACOUSTIC TRANSDUCER -- therefor.

IN THE SPECIFICATION:
Column 1, line 1, delete the title "SYSTEM OF COMPONENT S USABLE IN THE MANUFACTURE OF AN ACOUSTIC TRANSDUCER" and insert -- SYSTEM OF COMPONENTS USABLE IN THE MANUFACTURE OF AN ACOUSTIC TRANSDUCER -- therefor.

Signed and Sealed this
Eighth Day of November, 2011

David J. Kappos

David J. Kappos
*Director of the United States Patent and Trademark Office*